United States Patent [19]

Thompson

[11] 4,453,573

[45] * Jun. 12, 1984

[54] PAPERMAKERS FORMING FABRIC

[75] Inventor: Charles E. Thompson, Raleigh, N.C.

[73] Assignee: Huyck Corporation, Wake Forest, N.C.

[ * ] Notice: The portion of the term of this patent subsequent to Nov. 2, 1999 has been disclaimed.

[21] Appl. No.: 359,086

[22] Filed: Mar. 17, 1982

Related U.S. Application Data

[63] Continuation-in-part of Ser. No. 120,377, Feb. 11, 1980, Pat. No. 4,356,844.

[51] Int. Cl.[3] ..... D03D 15/00; D21F 1/10

[52] U.S. Cl. ..... 139/383 A; 139/425 A; 162/DIG. 1

[58] Field of Search ..... 139/383 A, 425 A, 383 R, 139/416; 162/DIG. 1, 348, 358; 245/10; 210/499, 501

[56] References Cited

U.S. PATENT DOCUMENTS

| | | | |
|---|---|---|---|
| 2,554,034 | 5/1951 | Koester et al. | 139/383 A |
| 2,903,021 | 9/1959 | Holden et al. | 138/383 A |
| 4,161,195 | 7/1979 | Khan | 139/383 A |
| 4,231,401 | 11/1980 | Matuska | 139/383 A |
| 4,356,844 | 11/1982 | Thompson | 139/383 A |

FOREIGN PATENT DOCUMENTS

| | | | |
|---|---|---|---|
| 1350537 | 12/1963 | France | 139/383 R |
| 1292860 | 10/1972 | United Kingdom . | |
| 1307599 | 2/1973 | United Kingdom . | |
| 1312552 | 4/1973 | United Kingdom . | |
| 1381651 | 1/1975 | United Kingdom . | |
| 1566258 | 4/1980 | United Kingdom . | |

OTHER PUBLICATIONS

*Advanced Textile Design,* by William Watson, pub. by Longmans Green & Co., 2nd Edition (1925), pp. 7 onwards and 13 onwards, especially e.g. Figs. 6 & 12.

Technology of Textile Design, E. A. Posselt, Author and publisher, 1896, pp. 114–115.

*Primary Examiner*—James Kee Chi

*Attorney, Agent, or Firm*—Kenway & Jenney

[57] ABSTRACT

An improved papermakers' fabric comprising warp and filling yarns woven in a preselected conventional unbalanced weave pattern modified such that the warp yarn of that pattern alternate with warp woven in accordance with the reverse of that pattern.

3 Claims, 12 Drawing Figures

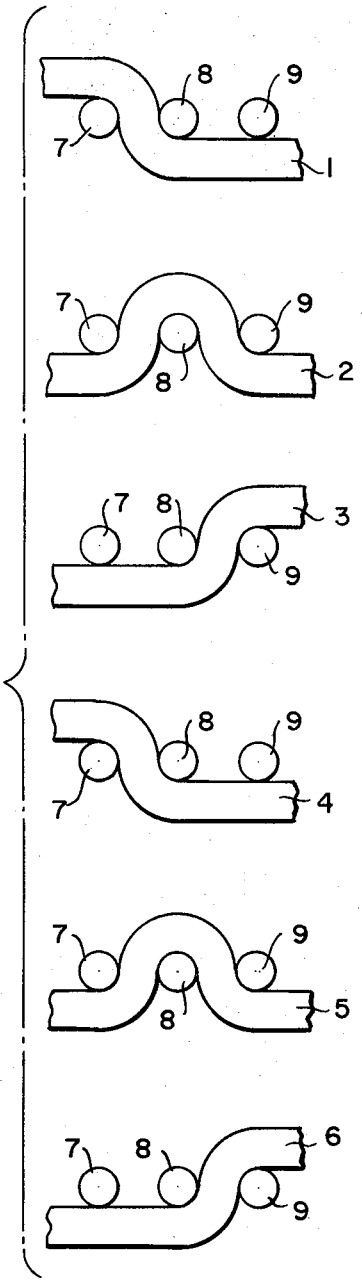
FIG. 5.
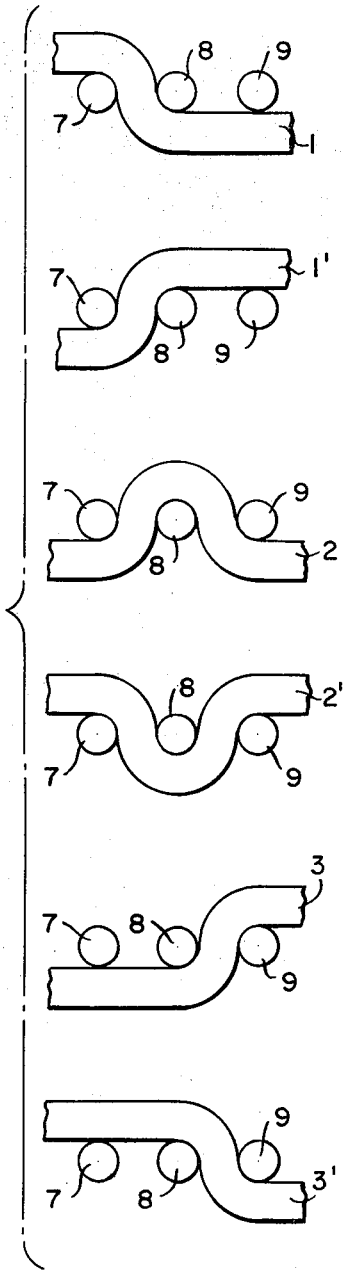
FIG. 6.
FIG. 7.
| 13 | 14 | 15 | 16 | 17 | 18 | 19 | 20 | 21 | 22 | |
|---|---|---|---|---|---|---|---|---|---|---|
| X | – | – | – | – | X | – | – | – | – | 23 |
| – | X | – | – | – | – | X | – | – | – | 24 |
| – | – | X | – | – | – | – | X | – | – | 25 |
| – | – | – | X | – | – | – | – | X | – | 26 |
| – | – | – | – | X | – | – | – | – | X | 27 |
FIG. 8.
| 13' | 14' | 15' | 16' | 17' | 18' | 19' | 20' | 21' | 22' | |
|---|---|---|---|---|---|---|---|---|---|---|
| – | X | X | X | X | – | X | X | X | X | 23 |
| X | – | X | X | X | X | – | X | X | X | 24 |
| X | X | – | X | X | X | X | – | X | X | 25 |
| X | X | X | – | X | X | X | X | – | X | 26 |
| X | X | X | X | – | X | X | X | X | – | 27 |

PAPERMAKERS FORMING FABRIC

CROSS-REFERENCE TO RELATED APPLICATION

This is a continuation-in-part of my copending application U.S. Ser. No. 120,377, filed Feb. 11, 1980 and entitled "PAPERMAKERS' FORMING FABRIC", now U.S. Pat. No. 4,356,844.

BACKGROUND OF THE INVENTION

1. Field of the Invention

The invention relates to a papermakers' fabric and more particularly to such a fabric free of edge curl while providing an excellent machine surface and an improved forming surface.

While the improved papermakers' fabric of the present invention could be advantageously used in the forming, transfer, press or drying sections of a papermaking machine, for purposes of an exemplary showing the fabric will be described in its application as a forming fabric.

2. Prior Art

Several well known types of papermaking machines utilize a forming fabric comprising a fabric of interwoven warp and filling yarns formed into an endless belt. A layer of wet pulp is deposited on the forming side of the papermakers' fabric and water is withdrawn from the pulp through the fabric by vacuum means or the like located on the machine side of the fabric.

Such papermakers' fabrics can be manufactured in two basic ways. First, they can be flat woven by a flat weaving process with their ends joined by any one of a number of well-known methods to form an endless belt. Alternatively, they can be woven directly in the form of a continuous belt by means of an endless weaving process. Both methods are well known in the art. In a flat woven papermakers' fabric, the warp yarns extend in the machine direction and the filling yarns extend in the cross-machine direction. In a papermakers' fabric having been woven in an endless fashion, the warp yarns extend in the cross-machine direction and the filling yarns extend in the machine direction. As used herein the terms "machine direction" and "cross-machine direction" refer respectively to a direction equivalent to the direction of travel of the papermakers' fabric on the papermaking machine and a direction transverse this direction of travel.

In the usual practice, papermakers' fabrics are manufactured utilizing weave patterns such as the $\frac{1}{2}$ twill, 2/1 twill, $\frac{2}{3}$ twill, 3/2 twill, $\frac{1}{4}$ twill, 4/1 twill, 1/5 twill, 5/1 twill and variations thereof such as the sateens. These most commonly used weave patterns have one characteristic in common. They are all unbalanced weaves yielding two-sided fabrics; one side being warp faced and the other side being filling faced. This characteristic leads to an imbalance of forces within the fabric structure, together with the different conditions which obtain at the edges of the papermakers' fabric when used on a papermaking machine (such differences including less lubrication by water, less vacuum being applied, etc.) result in a tendency of the papermakers' fabric to curl at its longitudinal edges. This tendency to curl results both in running problems and wear problems.

SUMMARY OF THE INVENTION

The present invention is based upon the discovery that if in a common unbalanced weave pattern (such as the $\frac{1}{2}$ twill, 2/1 twill, $\frac{1}{4}$ twill, 4/1 twill, $\frac{2}{3}$ twill, 3/2 twill, 1/5 twill, 5/1 twill, $\frac{1}{4}$ sateen and 4/1 sateen) the warp are alternated with the warp of the reverse of that pattern a more balanced weave is achieved and the forces within the resulting fabric are more nearly balanced. This, in turn, results in a flat fabric substantially free of edge curl and the problems attendant therewith.

Prior art workers have heretofore believed that a truly bicrimped fabric offered best sheet support and that the thinner the fabric the better its hydraulic action. Surprisingly, the weave patterns of the present invention eliminate pairing and yield a more bicrimped-like fabric. The forming side of the fabric displays improved sheet support and better sheet release. Sheet support is obtained from both yarn systems. The better sheet support is achieved through structural design rather than by providing a truly bicrimped fabric.

The fabric of the present invention has the same number of knuckles on both sides and therefore is balanced. It is also thicker with greater internal volume, and yet it runs cleaner and displays better drainage. At the same time, the machine side of the fabric is characterized by substantially no reduction in wear quality.

Accordingly, the invention provides an improved papermakers' fabric substantially free of the tendency to curl at its longitudinal edges and providing an improved forming surface. The fabric comprises warp and filling yarns woven in a preselected conventional unbalanced weave pattern modified such that every other warp yarn occupies a position with respect to the filling yarns which it would normally occupy in that preselected conventional unbalanced weave pattern, while the alternate yarns occupy a position with respect to the filling yarns which they would normally occupy in the reverse of that preselected conventional unbalanced weave pattern.

The teachings of the present invention are applicable to any one of the following conventional unbalanced weave patterns: a $\frac{1}{2}$ twill, a 2/1 twill, a $\frac{2}{3}$ twill, a 3/2 twill, a $\frac{1}{4}$ twill, a 4/1 twill, a 1/5 twill, a 5/1 twill, a $\frac{1}{4}$ sateen and a 4/1 sateen.

The improved uniform surface support and the greater internal volume of the fabric of the present invention would also be advantageous when used in the transfer, press or dryer sections of a papermaking machine.

Accordingly, it is an object of the present invention to provide a papermakers' fabric providing good drainage and sheet support and which is free of edge curl.

This and other objects, features and advantages of my invention will become apparent from a reading of the detailed description to follow, taken in conjunction with the accompanying drawings.

BRIEF DESCRIPTION OF THE DRAWINGS

In The Drawings:

FIG. 5 is a diagrammatic representation of the six warp yarns or ends of FIG. 1 and their relationship to the three filling yarns or picks thereof;

FIG. 6 is a diagrammatic representation, similar to FIG. 5, and illustrates the six warp yarns or ends of FIG. 3 and their relationship to the three filling yarns or picks thereof;

FIG. 7 is a weave diagram of a conventional ¼ twill weave pattern on 10 harnesses;

FIG. 8 is a weave diagram illustrating the underside of the weave pattern of FIG. 7;

BEST MODE OF CARRYING OUT THE INVENTION

Figure 1:
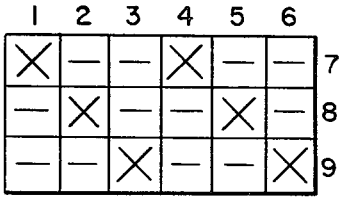
FIG. 1 is a weave diagram of a conventional $\frac{1}{2}$ twill weave pattern on six harnesses.

FIG. 1 illustrates a conventional ½ twill weave pattern woven on six harnesses. The six vertical rows numbered 1 through 6 represent the six warp yarns of the diagram. The "×" marks on the diagram represent those points at which warp yarns or ends 1 through 6 appear at the surface of the fabric.

In the diagram of FIG. 1, the horizontal rows represent the three filling yarns or picks of the diagram, numbered 7 through 9. The "—" marks in the diagram illustrate those points at which the filling yarns are at the surface of the fabric.

Figure 2:
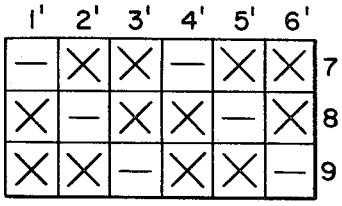
FIG. 2 is a weave pattern illustrating the underside of the pattern of FIG. 1.

FIG. 2 is a weave diagram similar to FIG. 1 and illustrates the underside or "reverse" of the weave pattern of FIG. 1. In FIG. 2, the positions of the "×" marks and "—" marks are simply interchanged with respect to their positions in FIG. 1.

FIGS. 1 and 2 illustrate clearly what was meant above by the statement that the conventional papermakers' unbalanced weave patterns are all characterized by the fact that they are two sided fabrics. The upper side of the fabric, as shown in FIG. 1, is filling faced. As can be clearly seen the filling yarns 7, 8 and 9, represented by the "—" marks, appear far more frequently than the warp yarns, represented by the "×" marks. The opposite is true of the underside of the fabric as is shown in FIG. 2. As a result, the underside of the fabric is conventionally termed warp faced.

When a papermakers' fabric of the type shown in FIGS. 1 and 2 is utilized as a forming fabric with its upper surface (represented by FIG. 1) serving as the forming surface and its lower surface (represented by FIG. 2) serving as the machine surface, better wear characteristics are obtained for the forming fabric, but the fabric is at the same time characterized by a poorer forming surface. This is true because there are fewer knuckles (i.e. "X" marks) to support the pulp fibers deposited thereon. Sheet release is also impaired. In such use of the fabric, the edges thereof tend to curl downwardly.

Papermakers have heretofore utilized a forming fabric of the type being discussed in an inverted condition so that its underside constitutes the forming surface of the fabric. This takes advantage of the greater number of knuckles (as is evident from FIG. 2) improving not only the surface of the sheet being made but also sheet release. Nevertheless, the fabric demonstrates poorer wear characteristics and service life. Furthermore, under these circumstances the edge curl, characteristic of such fabric, is an upward edge curl which further increases the problems attendant therewith.

FIG. 5 is a diagrammatic representation of the six warp yarns 1 through 6 and their relative positions with respect to the three filling yarns 7, 8 and 9. It will be evident from FIG. 5 that for each of the filling yarns 7, 8 and 9 only two of the warp yarns 1 through 6 pass thereover. This situation creates the above noted imbalance of forces within the fabric which, in turn, produces the tendency for edge curl.

Figure 3:
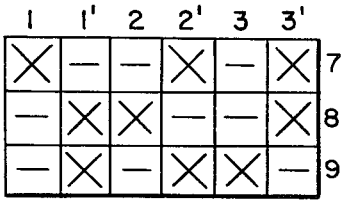
FIG. 3 is a weave diagram similar to FIG. 1 and illustrating the $\frac{1}{2}$ will pattern on six harnesses modified in accordance with the teachings of the present invention.
Figure 4:
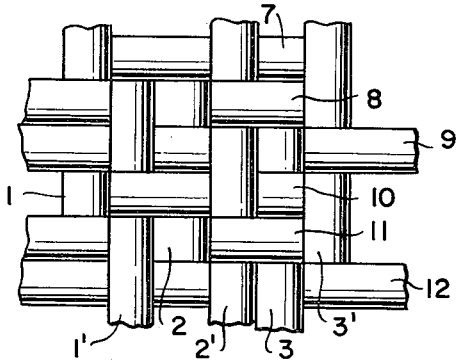
FIG. 4 is a fragmentary plan view of a fabric in accordance with the weave diagram of FIG. 3.

Reference is now made to FIG. 3. FIG. 3 is a weave diagram for a weave pattern or fabric in accordance with the teachings of the present invention. A comparison of FIGS. 1 and 2 with FIG. 3 will make it apparent that the weave pattern of FIG. 3 is a combination of warp 1, 2 and 3 positioned (woven) in accordance with FIG. 1 and warp 1', 2' and 3' positioned (woven) as in pattern of FIG. 2. Thus, the warp of FIG. 1 are alternated with and interspaced between the warp of the reverse pattern (FIG. 2). A further comparison of FIGS. 1 and 3 will make it immediately evident that the weave pattern of FIG. 3 is more balanced. The number of knuckles or "×" marks is equal to the number of warp yarn positions. The same is true of the reverse side of this weave pattern. FIG. 4 is a fragmentary plan view of a piece of fabric woven in accordance with the weave pattern of FIG. 3. FIG. 4 differs from FIG. 3 in that three additional filling yarns 10, 11 and 12 have been included so that the fabric may be more clearly represented. In FIGS. 3 and 4 it can be seen that weft 7, 8, 9, 10, 11 and 12 have the same number of warp passing thereover and thereunder.

Reference is now made to FIG. 6. FIG. 6 is a diagrammatic representation (similar to FIG. 5) illustrating the warp yarns 1, 1', 2, 2', 3 and 3' and their relative positions with respect to filling yarns 7, 8 and 9. It will be evident from FIG. 6 that each of the filling yarns 7, 8 and 9 have an equal number of warp yarns passing thereover and thereunder, unlike the situation which obtains in the weave pattern of FIGS. 1 and 5. It has been found that in a fabric of the type illustrated in FIGS. 3, 4 and 6 edge curl is no longer a problem. In addition, however, it has been found that pairing is eliminated with the result that the fabric is more bicrimped. This, together with the fact that the knuckles or "×" marks are more evenly distributed on both of the fabric surfaces results in better support for the sheet being formed on the forming surface with better sheet release and sheet surface characteristics while the wear characteristics of the papermakers' fabric are not impaired. The resulting papermakers' fabric is further characterized by less drag load on the paper machine, greater internal volume and better drainage.

FIGS. 7 through 12 illustrate another exemplary application of the teachings of the present invention to a conventional papermakers' unbalanced weave pattern. FIG. 7 illustrates a conventional ¼ twill on 10 harnesses. FIG. 8 is similar to FIG. 7 illustrating the reverse side of the weave pattern of FIG. 7. In both FIGS. 7 and 8 the 5 warp yarns or ends are indicated at 13 through 17 while the five filling yarns or picks are illustrated at 18 through 22. Again it will be readily evident from FIGS. 7 and 8 that the unbalanced ¼ twill weave shown therein is two sided, the upper side shown in FIG. 7 being filling faced while the underside shown in FIG. 8 is warped faced. The weave pattern of FIGS. 7 and 8 possess the same undesirable characteristics described with respect to the weave pattern of FIGS. 1 and 2.

Figures 11, 12:
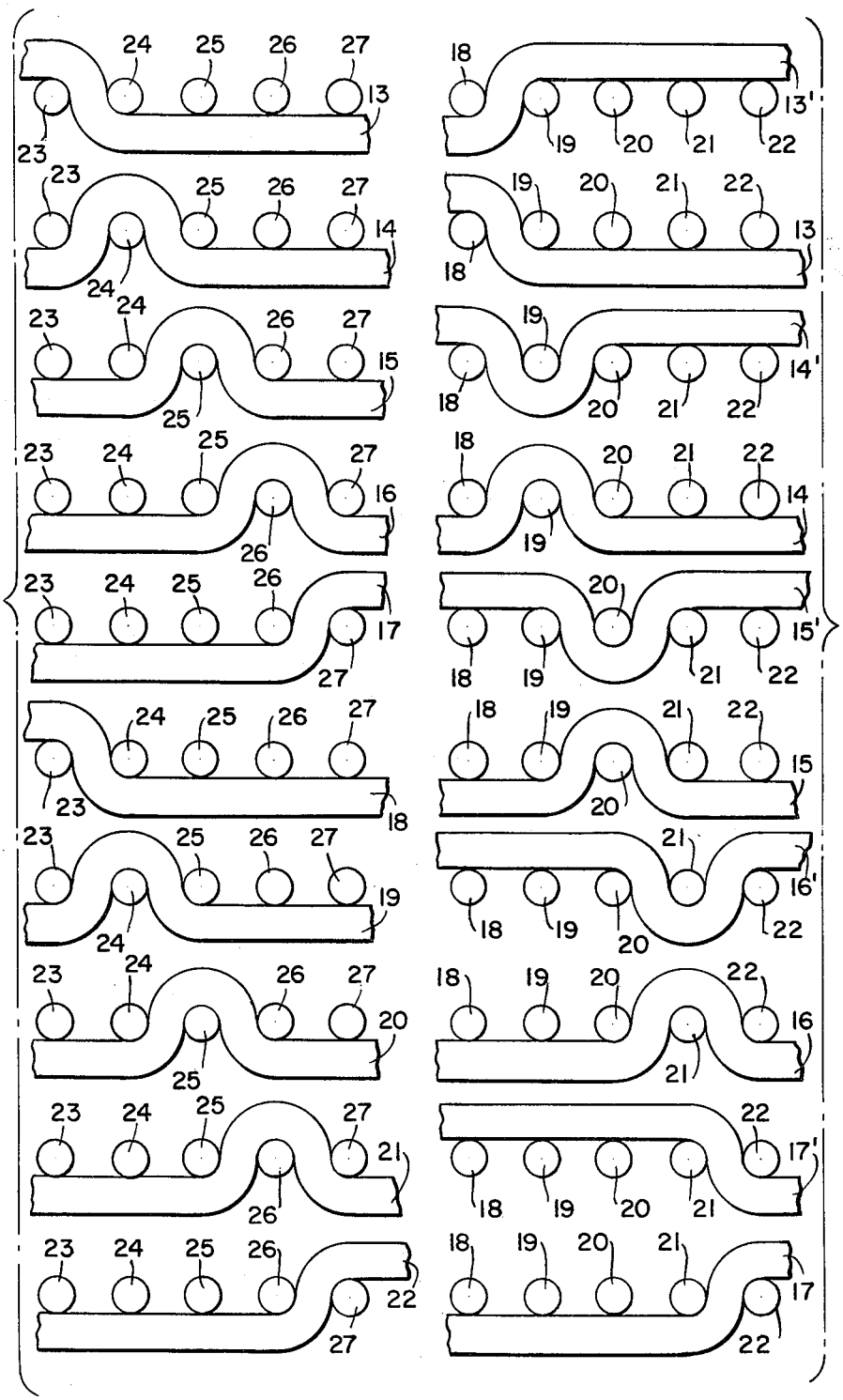
FIG. 11 is a diagrammatic representation of the 10 warp yarns or ends of FIG. 7 and their relationship to the five filling yarns or picks thereof.
FIG. 12 is a diagrammatic representation of the 10 warp yarns or ends of FIG. 9 and their relationship to the five filling yarns or picks thereof. de

FIG. 11 is a diagrammatic representation (similar to FIG. 5) illustrating the 5 warp yarns or ends 13 through 17 and their relative positions with respect to the five filling yarns or picks 18 through 22. Again it will be evident from FIG. 11 that each of the filling yarns or picks 18 through 22 has 8 of the 10 warp yarns or ends passing thereunder and only 2 warp yarns or ends passing thereover. This results in the same unbalanced condition within the fabric as described with respect to FIG. 5 above, resulting in edge curl and the like.

Figure 9:
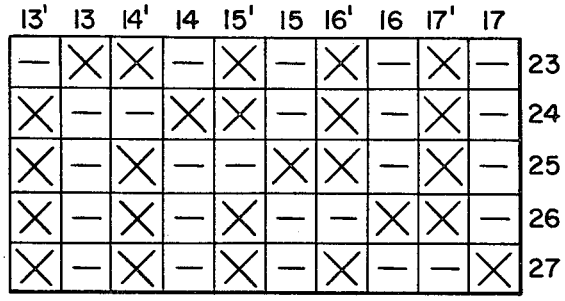
FIG. 9 is a weave diagram illustrating the ¼ twill weave pattern on 10 harnesses modified in accordance with the teachings of the present invention.
Figure 10:
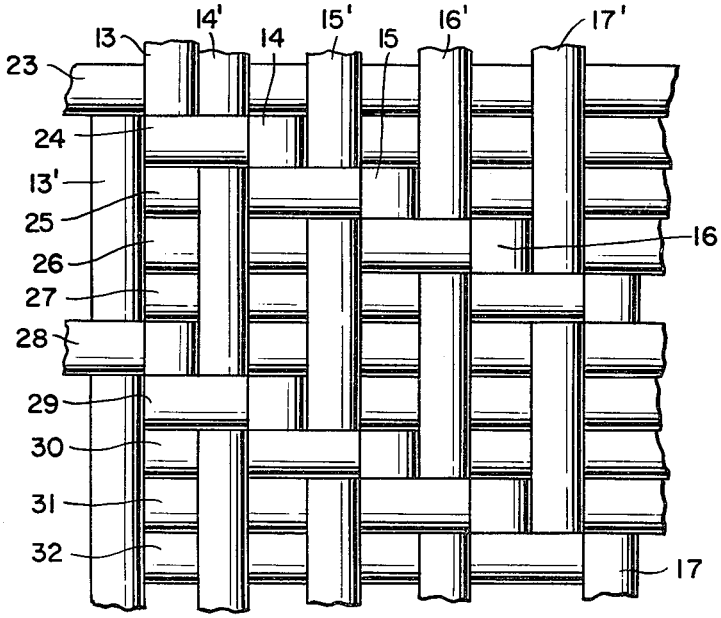
FIG. 10 is a fragmentary plan view of a fabric incorporating the weave pattern of FIG. 9.

FIG. 9 illustrates a $\frac{1}{4}$ twill on 10 harnesses of the type shown in FIGS. 7 and 8 modified in accordance with the present invention with the warp yarn of FIG. 7 alternating with the warp yarns of FIG. 8. The warp yarns of FIG. 7 are indicated at 13, 14, 15, 16 and 17 and those of FIG. 8 at 13', 14', 15', 16' and 17'. This again results in a much more even distribution of knuckles or "×" marks on both sides of the fabric. FIG. 12 is a diagrammatic representation of the warp yarns or ends 13, 13', 14, 14', 15, 15', 16, 16', 17 and 17' and their relative positions with respect to filling yarns or picks 18 through 22. Unlike the situation found in the diagrammatic representation of FIG. 11, each of the filling yarns or picks 18 through 22 has five warp yarns or ends passing thereover and five passing thereunder so that the forces within the fabric are more nearly balanced. FIG. 10 is a fragmentary plan view of a fabric woven in accordance with the weave pattern of FIG. 9 and the diagrammatic representation of FIG. 12. The fabric of FIG. 11 differs from the weave pattern of FIG. 9 only in that additional filling yarns or picks 23 through 27 are shown to better illustrate the fabric. The fabric of FIG. 10 is free of edge curl and is possessed of the same improved characteristics described with respect to the fabric of FIG. 4.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An endless loop monoplanar papermakers' fabric comprising inter-woven warp and filling yarn systems, said warp yarn system comprising warp yarns woven in a preselected conventional unbalanced papermakers' weave pattern chosen from the class consisting of a $\frac{1}{2}$ twill, a 2/1 twill, a $\frac{1}{4}$ twill, a 4/1 twill, a $\frac{2}{3}$ twill, a 3/2 twill, a 1/5 twill, a 5/1 twill, a $\frac{1}{4}$ sateen and a 4/1 sateen, combined and alternated with warp yarns woven in accordance the reverse of said preselected pattern so that each fill yarn has an equal number of warp yarns passing thereover and thereunder, whereby the forces within said fabric are balanced reducing the tendency to edge curl and said fabric is provided with an improved support surface.

2. The structure claimed in claim 1 wherein said papermakers' fabric comprises an endless belt for use in a section of a papermaking machine chosen from the class consisting of the forming section, the transfer section, the press section and the dryer section.

3. The structure claimed in claim 1 wherein said papermakers' fabric is a forming fabric.

* * * * *